United States Patent [19]

Gautraud

[11] Patent Number: 4,789,157

[45] Date of Patent: Dec. 6, 1988

[54] METHOD OF PLAYING A BOWLING GAME

[75] Inventor: Michael G. Gautraud, Muskegon, Mich.

[73] Assignee: Brunswick Corporation, Muskegon, Mich.

[21] Appl. No.: 118,248

[22] Filed: Nov. 9, 1987

[51] Int. Cl.[4] ..... A63D 5/00

[52] U.S. Cl. ..... 273/37; 273/54 C

[58] Field of Search ..... 273/37, 54 C, 54 R, 273/54 D

[56] References Cited

U.S. PATENT DOCUMENTS

| | | | |
|---|---|---|---|
| 3,153,538 | 10/1964 | Rogers | 273/43 D |
| 3,212,780 | 10/1965 | Jewell | 273/54 C |
| 3,529,824 | 9/1970 | Walch | 273/54 R |
| 4,597,575 | 7/1986 | Kosof | 273/37 |

FOREIGN PATENT DOCUMENTS

| | | | |
|---|---|---|---|
| 809541 | 4/1969 | Canada | 273/54 C |

*Primary Examiner*—Anton O. Oechsle

*Attorney, Agent, or Firm*—Wood, Dalton, Phillips, Mason & Rowe

[57] ABSTRACT

A method of playing a bowling game in which players are allowed at least one ball to knock down all pins in a plurality of frames defined by selecting a plurality of differing pin setups of less than ten pins in a random sequence. The number of pins less then ten that were not set for a respective frame is recorded for each player for each frame. The number of pins knocked down by each player in each frame is counted. The number of pins not set in a given frame is added to the frame score of the previous frame if all the pins were knocked down in the previous frame, but only the number of pins knocked down in the previous frame if all the pins were not knocked down in the previous frame. This frame score is recorded for each player, and each player's frame scores are added to determine the player's total score for the game. The players' game scores are compared to determine the winner of the game.

15 Claims, 1 Drawing Sheet

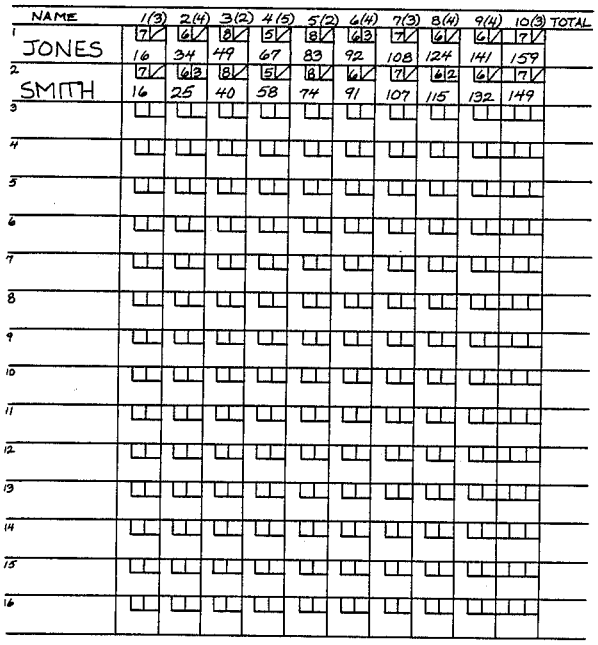

| NAME | 1(3) | 2(4) | 3(2) | 4(5) | 5(2) | 6(4) | 7(3) | 8(4) | 9(4) | 10(3) | TOTAL |
|---|---|---|---|---|---|---|---|---|---|---|---|
| 1 JONES | 7 ✓ | 6 ✓ | 8 ✓ | 5 ✓ | 8 ✓ | 6 3 | 7 ✓ | 6 ✓ | 6 ✓ | 7 ✓ | |
| | 16 | 34 | 49 | 67 | 83 | 92 | 108 | 124 | 141 | 159 | |
| 2 SMITH | 7 ✓ | 6 3 | 8 ✓ | 5 ✓ | 8 ✓ | 6 ✓ | 7 ✓ | 6 2 | 6 ✓ | 7 ✓ | |
| | 16 | 25 | 40 | 58 | 74 | 91 | 107 | 115 | 132 | 149 | |
| 3 | | | | | | | | | | | |
| 4 | | | | | | | | | | | |
| 5 | | | | | | | | | | | |
| 6 | | | | | | | | | | | |
| 7 | | | | | | | | | | | |
| 8 | | | | | | | | | | | |
| 9 | | | | | | | | | | | |
| 10 | | | | | | | | | | | |
| 11 | | | | | | | | | | | |
| 12 | | | | | | | | | | | |
| 13 | | | | | | | | | | | |
| 14 | | | | | | | | | | | |
| 15 | | | | | | | | | | | |
| 16 | | | | | | | | | | | |

METHOD OF PLAYING A BOWLING GAME

FIELD OF THE INVENTION

This invention generally relates to the sport of bowling and, particularly, to a method of playing a bowling game.

BACKGROUND OF THE INVENTION

Conventional bowling games are played by a method which depends on the order in which spares and strikes are scored by the players in turn. For many recreational or ordinary players, it is difficult to learn and understand the play of the game. This is because, in part, conventional bowling games require a strike or a spare to add a pin count for pins knocked down in subsequent frames to the pin counts in earlier frames. Quite often, running scores near the end of a game are not entered until the very last ball of a player is delivered. This cumbersome and difficult method of playing a conventional bowling game often leads to frustration and lack of interest to everyone but the skilled player. It is not uncommon for players to simply roll balls at pins and leave the scoring to others and never completely understand the rules of play. This leads to a lack of real interest and ultimately to players giving up on the sport.

In addition, conventional methods of playing bowling games often do not give a true indication of a player's skill. Leads shift back and forth during a game depending solely on sequences of strikes and spares, particularly near the end of a game. One player can build up such an early lead, again depending on his play timing, that other players lose hope and interest, and the level of play is greatly diminished.

There is a definite need for new methods of playing a bowling game which are more exciting during the entire play of the game; for games which are challenging but not difficult; and for games to increase and enhance the public interest in the sport. This invention is directed to satisfying these needs and to rectifying problems inherent in the conventional method of playing a bowling game. In addition, the method of playing the bowling game in accordance with this invention not only provides a different method of play, but affords players an opportunity to concentrate on delivering balls at "spares", i.e. less than a full ten-pin setup. This aids in a bowler's training program.

SUMMARY OF THE INVENTION

An object of the invention, therefore, is to provide a new method of playing a bowling game in which players are allowed at least one ball to knock down all pins in a plurality of frames.

According to the method of this invention, a plurality of differing pin setups of less than ten pins are selected in a random sequence from a list of the most frequent "spares" encountered in bowling, to define the plurality of frames. The number of pins less than ten that were not set up for the respective frame is recorded for each player for each frame. Each player is required to deliver at least one ball in each of the frames. The number of pins knocked down by each player in each frame is counted. The number of pins not set in a given frame is added to the frame score of the previous frame if all the pins were knocked down in the previous frame and only the number of pins knocked down in the previous frame if all the pins were not knocked down in the previous frame. This determines a frame score for each player for each frame. Each player's frame score is recorded, and each player's frame scores are added to determine the player's total score for the game. The players' game scores are compared to determine the winner of the game.

Preferably, each player is allowed to deliver only one ball in each frame, and preferably all players are presented with the same pin setup in each of the frames as determined by the random selection.

A feature of the invention can include having each player be allowed to deliver at least one ball at a full ten-pin setup after the last frame of the game to add a score to the last frame if the player knocks down all pins in the last frame.

Other objects, features and advantages of the invention will be apparent from the following detailed description taken in connection with the accompanying drawing.

BRIEF DESCRIPTION OF THE DRAWING

The features of this invention which are believed to be novel are set forth with particularity in the appended claims. The invention, together with its objects and the advantages thereof, may be best understood by reference to the following description taken in conjunction with the accompanying drawing showing a simulated score sheet which might be used in playing the bowling game of this invention.

DETAILED DESCRIPTION OF THE PREFERRED EMBODIMENT

The method of playing the bowling game according to this invention generally allows each player at least one ball to knock down all pins in a plurality of frames. The method is designed to present to the players different pin setups of less than ten pins. In other words, the game simulates a sequence of the players attempting to score a "spare". Only after all of the frames have been played, will a player be presented with a full ten-pin setup, as described below.

Specifically, the method of playing the bowling game contemplates selecting a plurality of differing pin setups of less than ten pins. Preferably, the differing pin setups are selected in a random sequence to define the plurality of frames. In addition, the differing pin setups are selected from a list of the most frequently encountered "spares" in conventional bowling, such as the top thirty most frequent spares. When the less-than-ten pin setup frames are set, the number of pins less than ten that were not set for the respective frame is recorded for each player for each frame. Therefore, a conventional bowling score sheet as shown in the Figure of the drawing can be used to keep score during the game.

During play, each player is required to deliver at least one ball at each of the frames. Preferably, each player is allowed to deliver only one ball in each frame. This better simulates players attempting to score a "spare". Of course, the invention is not limited to any of the specific steps other than as claimed.

The number of pins knocked down by each player in each frame is counted. The number of pins not set in a given frame is added to the frame score of the previous frame if all the pins were knocked down in the previous frame and only the number of pins knocked down in the previous frame if all the pins were not knocked down in the previous frame. This determines a frame score for each player for each frame, which is recorded on the score sheet.

At the end of the game, each player's frame scores are added to determine the player's total score for the game. The players' game scores are compared to determine the winner of the game.

In order not to leave the last frame score "hanging", each player may be allowed to deliver at least one ball at a full ten-pin setup after the last frame of the game. This adds a score to the last frame equal to the number of pins knocked down of the full ten-pin setup, if the player knocked down all pins in the last frame.

Referring to the Figure, assume that a twosome of "Jones" and "Smith" are playing a bowling game according to the method of this invention. The game is prepared by selecting a plurality of differing pin setups of less than ten pins to define a plurality of frames, such as the ten frames indicated on the score sheet. Preferably, the differing pin setups are selected in a random sequence, and from the list of most frequent spares. This can be done manually by simple index cards, by player selection or by a computerized random selection system. After the sequence of differing pin setups are selected, the number of pins in each frame may be shown after the frame number designation if the players so desire. For instance, the sequence shown in the Figure includes a series of differing pin setups of 3, 4, 2, 5, 2, 4, 3, 4, 4 and 3 pins for each of the frames 1–10, respectively. It is not necessary that the numbers of pins in each frame be so designated for the entire game because, as shown on the score sheet, each player is given "credit" for the "missing" pins in relation to a full ten-pin setup, as if each player had knocked down that number of pins on his respective first ball. By marking the sequence of differing pin setups, the players simply can look forward during the game to the various numbers of pins allotted.

The number of pins less than ten that were not set for the respective frame then is recorded for each player for each frame, as illustrated. In other words, the numbers "7-6-8-5-8-6-7-6-6-7" are inserted for each player for each frame by subtracting the number of pins in each of the differing pin setups from "10", i.e. a full ten-pin setup frame.

In the first frame, Jones knocks down all three pins and is given a conventional "spare" score indication in his column under the first frame. Likewise, Smith knocked down all three pins with his first ball and accordingly is given a "spare" score which is recorded, as shown. At this point, it should be understood that although the players may be allowed to deliver more than one ball up to a given maximum, preferably the method of playing the bowling game allows each player to deliver only one ball in each frame. This would better simulate the players attempting to score "spares" after delivering an imaginary first ball.

Since Jones and Smith both scored spares in the first frame, the imaginary first ball of the second frame, i.e. knocking down "6" pins, is added to the first frame for a running, tied score of "16".

In the second frame, Jones again scores a spare and, therefore, the first imaginary ball in the third frame is added to his second frame score. In other words, since the pin setup in the third frame includes only two pins, 8 pins are added to Jones' score for the second frame, or "18", and a running score of "34". Unfortunately, Smith knocked down only three balls in the second frame and, therefore, the eight pins on the imaginary ball in the third frame cannot be added, resulting in Smith being given only 9 pins for the second frame and a running total of "25" through the second frame. This simplified scoring proceeds throughout the entire game until, as can be seen, both Jones and Smith score a spare in the tenth frame. The score through nine frames is 141 for Jones and 132 for Smith.

In order not to leave the last or tenth frame "hanging", an additional pin setup is presented after the tenth frame. One scheme, according to the method of this invention, is to allow each player to deliver at least one ball at a full ten-pin setup after the last frame in order to add a score to the last frame if a score was recorded in the last frame. Of course, other than a ten-pin setup might be used. In addition, preferably, each player is allowed to deliver only one ball at the full ten-pin setup. In the simulated game shown in the Figure, both Jones and Smith scored a spare in the last frame. Jones knocked down eight pins of the full ten-pin setup, resulting in a final score of 159 for the game. Smith knocked down seven pins of the ten-pin setup, resulting in a final score of 149. Accordingly, Jones won the game.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A method of playing a bowling game in which players are allowed at least one ball to knock down all pins in a plurality of frames, said method comprising:

(a) selecting a plurality of differing pin setups of less than ten pins in a random sequence to define said plurality of frames;

(b) recording for each player for each frame the number of pins less than ten that were not set for the respective frame;

(c) requiring each player to deliver at least one ball in each of said frames;

(d) counting the number of pins knocked down by each player in each frame;

(e) adding the number of pins not set in a given frame to the frame score of the previous frame if all the pins were knocked down in the previous frame and only the number of pins knocked down in the previous frame if all the pins were not knocked down in the previous frame, to determine a frame score for each player for each frame;

(f) recording each player's frame score;

(g) adding each player's frame scores to determine said player's total score for the game; and (h) comparing the players' game scores to determine the winner of the game.

2. The method of claim 1 wherein each player is allowed to deliver only one ball in each frame.

3. The method of claim 1 wherein all players are presented with the same pin setup in each of said frames as determined by said random selection.

4. The method of claim 1 wherein each said pin setup for each player is randomly selected.

5. The method of claim 1 wherein each player is allowed to deliver at least one ball at a full ten-pin setup after the last frame of the game to add a score to the last frame if the player knocked down all the pins in the last frame.

6. The method of claim 5 wherein each player is allowed to deliver only one ball at said full ten-pin setup.

7. The method of claim 1 wherein the pin setups are selected from a list of most frequently encountered spares.

8. A method of playing a bowling game in which players are allowed at least one ball to knock down all pins in a plurality of frames, said method comprising:

(a) selecting a plurality of differing pin setups of less than ten pins in a random sequence to define said plurality of frames, the sequence and differing pin setups in each frame being the same for each player;

(b) recording for each player for each frame the number of pins less than ten that were not set for the respective frame;

(c) requiring each player to deliver only one ball in each of said frames;

(d) counting the number of pins knocked down by each player in each frame;

(e) adding the number of pins not set in a given frame to the frame score of the previous frame if all the pins were knocked down in the previous frame and only the number of pins knocked down in the previous frame if all the pins were not knocked down in the previous frame, to determine a frame score for each player for each frame;

(f) recording each player's frame score;

(g) adding each player's frame scores to determine said player's total score for the game; and (h) comparing the players' game scores to determine the winner of the game.

9. The method of claim 8 wherein each player is allowed to deliver at least one ball at a full ten-pin setup after the last frame of the game to add a score to the last frame if the player knocked down all the pins in the last frame.

10. The method of claim 9 wherein each player is allowed to deliver only one ball at said full ten-pin setup.

11. The method of claim 8 wherein each player is allowed to deliver only one ball at said full ten-pin setup.

12. A method of playing a bowling game in which players are allowed at least one ball to knock down all pins in a plurality of frames, said method comprising:

(a) selecting a plurality of differing pin setups of less than ten pins to define a plurality of frames;

(b) recording for each player for each frame the number of pins less than ten that were not set for the respective frame;

(c) requiring each player to deliver at least one ball in each of said frames;

(d) counting the number of pins knocked down by each player in each frame;

(e) adding the number of pins not set in a given frame to the frame score of the previous frame if all the pins were knocked down in the previous frame and only the number of pins knocked down in the previous frame if all the pins were not knocked down in the previous frame, to determine a frame score for each player for each frame;

(f) recording each player's frame score;

(g) adding each player's frame scores to determine said player's total score for the game; and (h) comparing the players' game scores to determine the winner of the game.

13. The method of claim 12 wherein each player is allowed to deliver only one ball in each frame.

14. The method of claim 12 wherein each player is allowed to deliver at least one ball at a full ten-pin setup after the last frame of the game to add a score to the last frame if the player knocked down all the pins in the last frame.

15. The method of claim 14 wherein each player is allowed to deliver only one ball at said full ten-pin setup.

* * * * *